US012673757B2

(12) United States Patent
Ono

(10) Patent No.: US 12,673,757 B2
(45) Date of Patent: Jul. 7, 2026

(54) WATER JET PROPULSION BOAT

(71) Applicant: YAMAHA HATSUDOKI KABUSHIKI KAISHA, Iwata (JP)

(72) Inventor: Junya Ono, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 351 days.

(21) Appl. No.: 18/429,604

(22) Filed: Feb. 1, 2024

(65) Prior Publication Data

US 2024/0300631 A1 Sep. 12, 2024

(30) Foreign Application Priority Data

Mar. 6, 2023 (JP) ..... 2023-033378

(51) Int. Cl.

| | |
|---|---|
| ***B63H 11/08*** | (2006.01) |
| ***B63B 34/10*** | (2020.01) |
| ***B63H 21/17*** | (2006.01) |
| *B63H 11/103* | (2006.01) |
| *B63H 25/46* | (2006.01) |

(52) U.S. Cl.

CPC ..... *B63H 11/08* (2013.01); *B63B 34/10* (2020.02); *B63H 21/17* (2013.01); *B63H 2011/081* (2013.01); *B63H 11/103* (2013.01); *B63H 25/46* (2013.01)

(58) Field of Classification Search

CPC ..... B63H 11/00; B63H 11/04; B63H 11/08; B63H 21/00; B63H 21/17; B63H 25/46; B63H 2011/081; B63H 11/103; B63B 34/00; B63B 34/10

USPC ..... 440/6, 38

See application file for complete search history.

(56) References Cited

U.S. PATENT DOCUMENTS

| | | | | |
|---|---|---|---|---|
| 4,941,854 | A * | 7/1990 | Takahashi | B63B 34/10 114/55.57 |
| 8,911,271 | B2 * | 12/2014 | Shibayama | B63H 21/17 440/38 |
| 9,321,516 | B1 * | 4/2016 | Lafreniere | B63H 21/20 |
| 12,397,879 | B1 * | 8/2025 | Scaringe | B63H 21/17 |
| 2013/0137317 | A1 | 5/2013 | Shibayama | |

FOREIGN PATENT DOCUMENTS

JP 2013-107596 A 6/2013

* cited by examiner

*Primary Examiner* — Lars A Olson

(74) *Attorney, Agent, or Firm* — Keating & Bennett, LLP

(57) ABSTRACT

A water jet propulsion boat includes a hull, a drive source, a power storage, a jet propulsion mechanism, a power generator, and a controller. The hull includes a water inlet, a jet outlet, and a flow path connecting the water inlet and the jet outlet and including at least a main flow path extending from the water inlet to the jet outlet. The drive source is located in the hull, and the power storage supplies power to the drive source. The jet propulsion mechanism includes an impeller in the main flow path and driven by a driving force of the drive source to generate a water flow to generate a propulsive force to the hull. The power generator is located in the flow path and uses the water flow generated by the impeller to generate power. The controller charges the power storage with the power generated by the power generator.

19 Claims, 8 Drawing Sheets

WATER JET PROPULSION BOAT

CROSS REFERENCE TO RELATED APPLICATIONS

This application claims the benefit of priority to Japanese Patent Application No. 2023-033378 filed on Mar. 6, 2023. The entire contents of this application are hereby incorporated herein by reference.

BACKGROUND OF THE INVENTION

1. Field of the Invention

The technologies disclosed herein relate to water jet propulsion boats.

2. Description of the Related Art

A water jet propulsion boat includes a hull, a drive source, and a jet propulsion mechanism. The jet propulsion mechanism is driven by the drive source and generates a water flow toward the rear of the hull to propel the hull.

A boat having a hull, a drive source, and a propulsion unit including an impeller has been disclosed, wherein the boat is propelled by jetting backward a water flow generated by the rotation of the impeller. The water flow generated by the impeller is used not only to propel the hull but also to cool the drive source (see JP 2013-107596 A).

SUMMARY OF THE INVENTION

The water flow generated by the impeller has not been used other than to propel the hull or to cool the drive source, as disclosed in the prior art cited above.

Preferred embodiments of the present invention disclose technologies that are able to solve the above-mentioned problems.

The technologies disclosed herein can be implemented, e.g., in the following aspects.

A water jet propulsion boat according to a preferred embodiment of the present invention includes a hull, a drive source, a power storage, a jet propulsion mechanism, a power generator, and a controller. The hull includes a water inlet, a jet outlet, and a flow path connecting the water inlet and the jet outlet and including a main flow path extending from the water inlet to the jet outlet. The drive source is in the hull, and the power storage supplies power to the drive source. The jet propulsion mechanism includes an impeller in the main flow path and driven by a driving force of the drive source to generate a water flow in the flow path to generate a propulsive force. The power generator is in the flow path and uses the water flow generated by the impeller to generate power. The controller is configured or programmed to charge the power storage with the power generated by the power generator.

The water jet propulsion boat charges the power storage with the power generated by the power generator that uses the water flow generated by the impeller to generate power thus effectively utilizing the water flow generated by the impeller and extending the cruising range of the jet propulsion boat.

A water jet propulsion boat according to another preferred embodiment of the present invention includes a hull, a drive source, a jet propulsion mechanism, a power generator, electrical equipment, and a controller. The hull includes a water inlet, a jet outlet, and a flow path connecting the water inlet and the jet outlet and including a main flow path extending from the water inlet to the jet outlet. The drive source is in the hull. The jet propulsion mechanism includes an impeller in the main flow path and driven by the driving force of the drive source to generate a water flow in the flow path to generate a propulsive force to the hull. The power generator is in the flow path and generates power by using the water flow generated by the impeller. The electrical equipment is in the hull. The controller is configured or programmed to supply the power generated by the power generator to the electrical equipment.

This water jet propulsion boat supplies the power generated by the power generator, which uses the water flow generated by the impeller to generate power, to the electrical equipment thus effectively using the water flow generated by the impeller.

The technologies disclosed herein can be implemented in various aspects including, e.g., water jet propulsion boats, methods for manufacturing water jet propulsion boats, and the like.

The water jet propulsion boats disclosed herein can charge the power storage with electric power generated by the power generator which uses the water flow generated by the impeller to generate power thus effectively using the water flow generated by the impeller.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
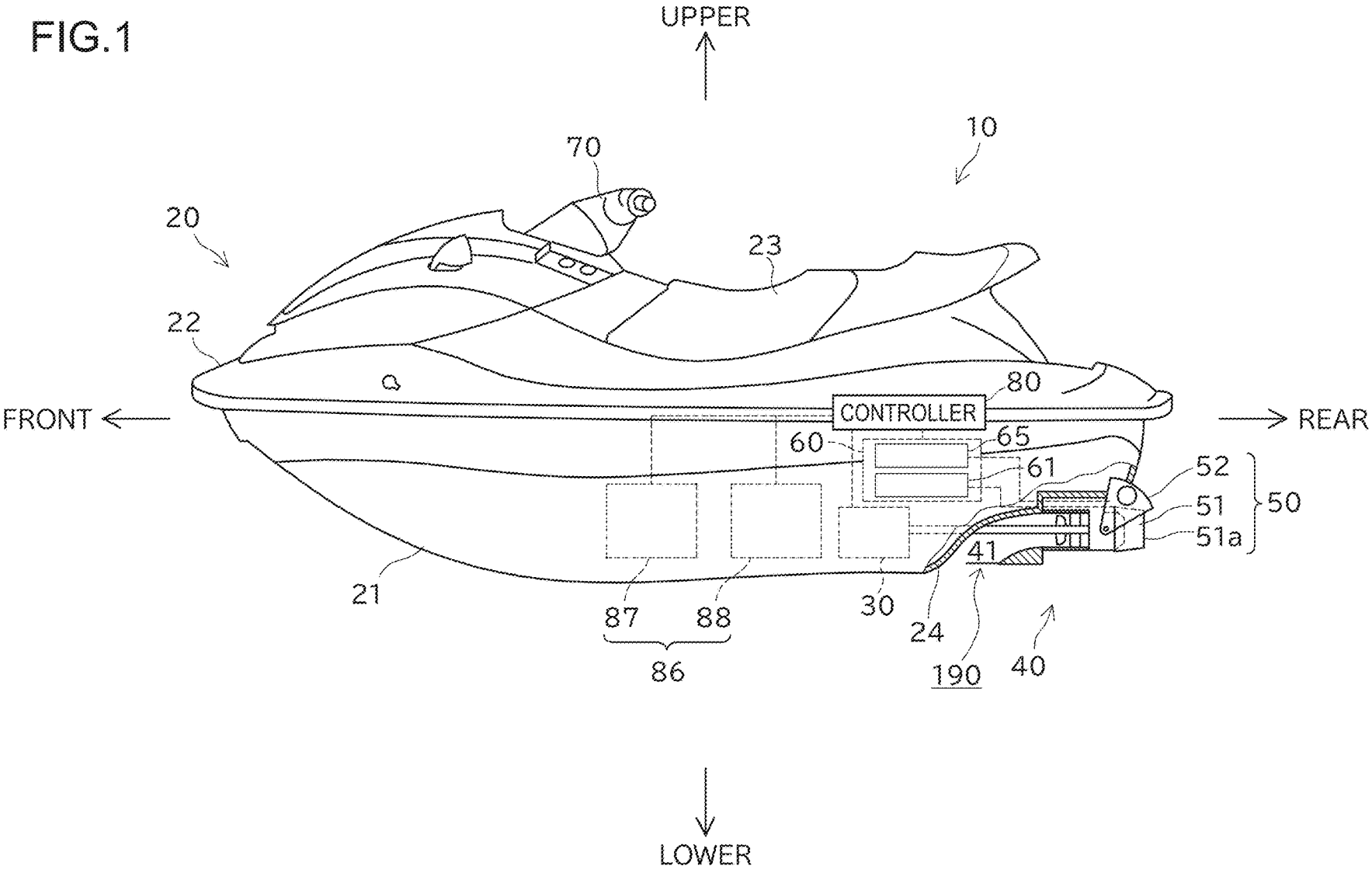
FIG. 1 is a side view schematically illustrating a configuration of a water jet propulsion boat according to a preferred embodiment of the present invention.
Figure 2:
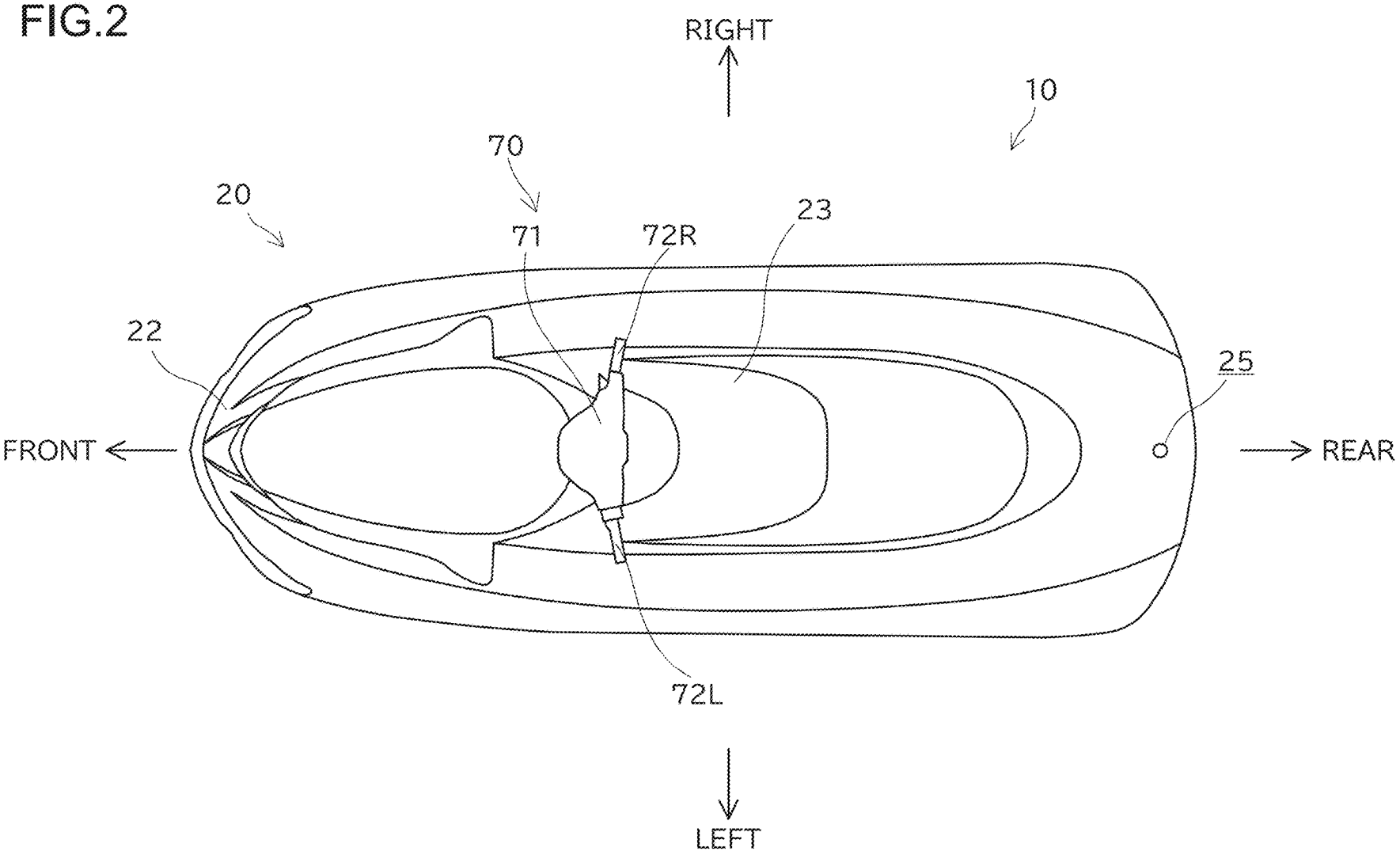
FIG. 2 is a top view schematically illustrating a configuration of the water jet propulsion boat according to a preferred embodiment of the present invention.

FIG. 1 is a side view schematically illustrating a configuration of a water jet propulsion boat 10 according to a preferred embodiment of the present invention. FIG. 2 is a top view schematically illustrating a configuration of the water jet propulsion boat 10. FIGS. 1 and 2, as well as other figures to be described below, show arrows representing each direction with respect to the position of the water jet propulsion boat 10. More specifically, each figure shows arrows representing front (FRONT), rear (REAR), left (LEFT), right (RIGHT), upper (UPPER), and lower (LOWER), respectively. The front-rear direction, the left-right direction, and the upper-lower (vertical) direction are each perpendicular to each other.

The water jet propulsion boat 10 may be, e.g., a personal watercraft (PWC). The water jet propulsion boat 10 includes a hull 20, a driving device 30, a jet propulsion mechanism 40, a jet adjustment mechanism 50, a displacement mechanism 60, a steering device 70, a controller (control unit) 80, electrical equipment 84 (described below), a power storage 86, and a power generator 100 (described below).

The hull 20 includes a hull body 21, a deck 22, a seat 23, and a mounting portion 24. The hull body 21 define the bottom of the hull 20. The deck 22 defines the top of the hull 20. The deck 22 is provided with a spout ejection port 25 (see FIG. 2). The spout ejection port 25 is supplied with spout water SW, which will be described below. The water jet propulsion boat 10 ejects water upward with respect to the hull 20 from the spout ejection port 25 so that the crews of other boats can recognize the presence of the water jet propulsion boat 10 even when the waves in the vicinity are high. The seat 23 is positioned approximately in the center of the hull 20 in the front-rear direction so that a user (crew) not shown can sit. The mounting portion 24 houses the driving device 30 and the jet propulsion mechanism 40 and is attached to the lower portion of the hull body 21. The hull 20 also includes flow paths 190, including at least the main flow path 41, as will be described in detail below.

Figure 3:
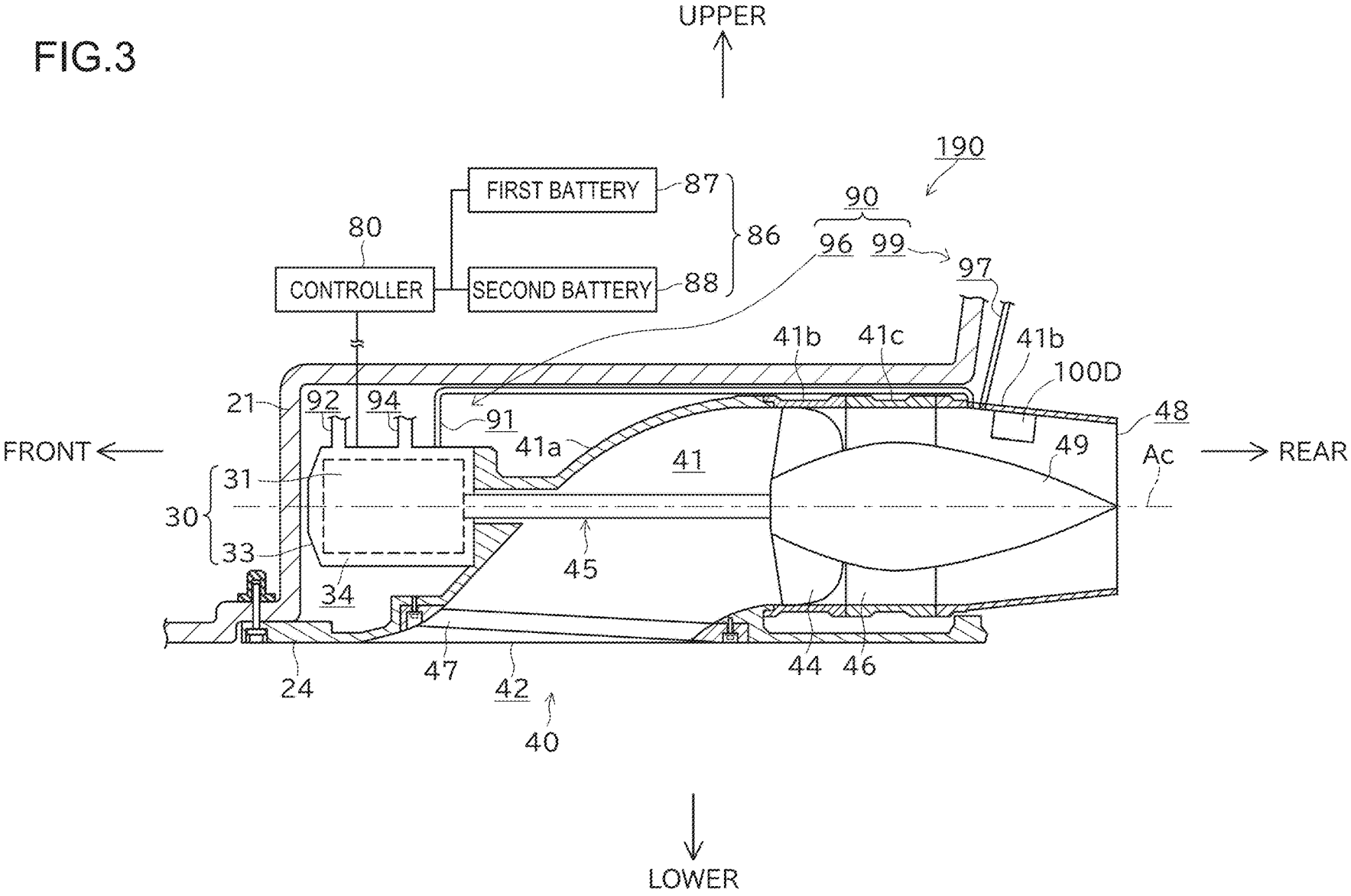
FIG. 3 is an explanatory view schematically illustrating a peripheral configuration of a driving device and a jet propulsion mechanism.

FIG. 3 is an explanatory view schematically illustrating a peripheral configuration of a driving device 30 and a jet propulsion mechanism 40. As shown in FIG. 3, the driving device 30 is located at a lower position of the hull 20. The driving device 30 includes a motor 31 and a water jacket 33. The motor 31 is, e.g., a brushless motor. The motor 31 is driven to rotate around an output shaft (not shown) by electric power supplied from the power storage 86. The water jacket 33 covers the outside of the motor 31. In the space between the motor 31 and the water jacket 33, there is provided a cooling water tank 34 into which cooling water CW is supplied from the cooling water introduction path 91 described below to cool the motor 31, and the motor 31 is cooled by the cooling water CW supplied to the cooling water tank 34. The motor 31 is an example of a drive source.

The jet propulsion mechanism 40 generates a propulsive force to the hull 20. The jet propulsion mechanism 40 is located at a rear and lower position of the hull 20. The jet propulsion mechanism 40 includes a duct 41*a*, an impeller housing 41*b*, a stator blade housing 41*c*, a nozzle 41*d*, an impeller 44, a drive shaft 45, a stator blade 46, a screen 47, and a housing 49.

The duct 41*a*, the impeller housing 41*b*, the stator blade housing 41*c*, and the nozzle 41*d* are each a cylindrical or substantially cylindrical body extending in the front-rear direction. The duct 41*a* includes a water inlet 42 to suck in water, and the nozzle 41*d* includes a jet outlet 48 to eject the jet JW described below and that is generated by the impeller 44. The spaces inside each of the duct 41*a*, the impeller housing 41*b*, the stator blade housing 41*c*, and the nozzle 41*d* are connected to each other to define the main flow path 41, which is connected to the water inlet 42 and the jet outlet 48 and extends from the water inlet 42 to the jet outlet 48.

The drive shaft 45, the impeller 44, the stator blades 46, and the screen 47 are located in the main flow path 41. The drive shaft 45 is a rod-shaped member and is connected to the rear end of the output shaft (not shown) of the motor 31. The impeller 44 includes a plurality of blades and is attached to the rear of the drive shaft 45. The stator blade 46 includes a plurality of blades. The screen 47 is a lattice-shaped member and is mounted near the water inlet 42 to prevent foreign matter from entering the main flow path 41.

The housing 49 rotatably supports the drive shaft 45 via a plurality of bearings (not shown) disposed inside the housing 49. Accordingly, the impeller 44 rotates in unison with the drive shaft 45 about the rotation axis Ac of the drive shaft 45. On the other hand, the stator blade 46 is fixed to the housing 49 and the stator blade housing 41*c*. Therefore, the stator blade 46 is non-rotatable.

With this configuration, when the output shaft of the motor 31 rotates by electric power supplied from the power storage 86 to the motor 31 via the controller 80, the driving force of the motor 31 is transmitted to the drive shaft 45. When the impeller 44 rotates along with the rotation of the drive shaft 45, water outside of the hull 20 (below the hull body 21) is sucked into the main flow path 41 via the water inlet 42, generating a water flow in the main flow path 41. The water flow generated in the main flow path 41 is sent from the impeller 44 to the stator blade 46. As mentioned above, since the stator blade 46 is fixed by the housing 49 and the stator blade housing 41*c* regardless of the movement of the impeller 44, the water flow sent to the stator blade 46 is rectified by reducing the twisting caused by the rotation of the impeller 44. The rectified water is sent from the stator blade 46 to the nozzle 41*d* and is jetted backward from the jet outlet 48. This creates a jet stream JW that provides a forward propulsive force. Because of this configuration, the higher the rotational speed of the motor 31, the higher the flow rate of the jet stream JW ejected from the jet propulsion mechanism 40. Therefore, the amount (jet force) of the jet stream JW ejected from the jet propulsion mechanism 40 can be adjusted by changing the operating state (rotational speed) of the motor 31.

The jet adjustment mechanism 50 includes a deflector 51 and a reverse gate 52. The displacement mechanism 60 includes a deflector moving mechanism 61 and a reverse gate moving mechanism 65 (see FIG. 1).

The deflector 51 is a cylindrical or substantially cylindrical (frustoconical) member with an inner diameter decreasing toward the rear. The deflector 51 is positioned behind the nozzle 41*d* and covers the jet outlet 48 of the nozzle 41*d* (see FIG. 1). Thus, the jet JW ejected from the jet outlet 48 of the nozzle 41*d* passes through the deflector 51 and is ejected from the ejection port 51*a*. The deflector 51 is rotatable around the vertical and horizontal axes behind the jet outlet 48. In other words, the deflector 51 can change the left-right direction and upper-lower direction of the jet stream JW ejected from the jet outlet 48 to the rear of the hull 20 according to its rotational position. The deflector moving mechanism 61 moves the deflector 51 according to the operation of the steering device 70.

The reverse gate 52 is disposed behind the deflector 51 (see FIG. 1) and can be moved between the forward, neutral, and backward positions. The forward position is the position where the reverse gate 52 does not cover the ejection port 51*a* of the deflector 51 in the front-rear direction, and when the reverse gate 52 is in the forward position, the hull 20 moves forward by the ejection of the jet JW. The neutral position is the position where the reverse gate 52 covers a portion of the ejection port 51*a* of the deflector 51 in the front-rear direction, and when the reverse gate 52 is in the neutral position, the hull 20 is decelerated by the ejection of the jet JW. The backward position is the position where the reverse gate 52 covers the entire ejection port 51*a* of the deflector 51 in the front-rear direction, and when the reverse gate 52 is in the backward position, the hull 20 moves backward by the ejection of the jet JW. The reverse gate moving mechanism 65 moves the reverse gate 52 in response to the operation of the steering device 70.

The steering device 70 includes a steering handle 71, a right grip portion 72R, and a left grip portion 72L (see FIG. 2). The steering handle 71 includes a pair of bar-shaped sections extending in the left-right direction with respect to the hull 20 and is supported pivotably around a pivot axis along the upper-lower direction. The right grip portion 72R is provided on the right side of the steering handle 71, and the left grip portion 72L is provided on the left side of the steering handle 71. The user of the water jet propulsion boat 10 can turn the steering handle 71 by gripping the right grip portion 72R and the left grip portion 72L. By turning the steering handle 71, the deflector 51 can be turned in the left-right direction via the displacement mechanism 60. The steering device 70 includes a plurality of controls (not shown), and the user can operate the controls to start and stop the motor 31, to rotate the deflector 51 in the vertical direction, or to rotate the reverse gate 52.

Figure 4:
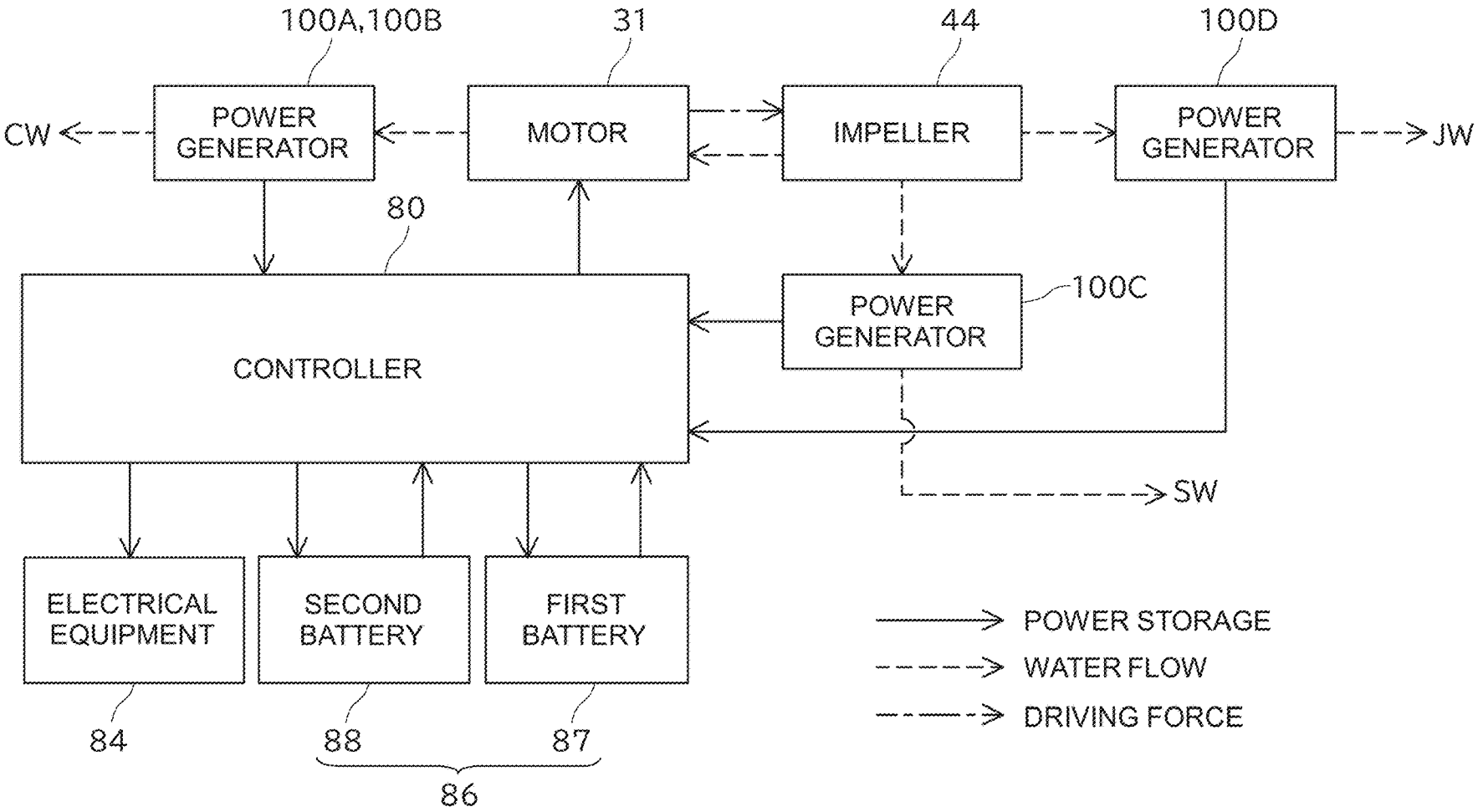
FIG. 4 is a block diagram illustrating a control configuration of the water jet propulsion boat.

FIG. 4 is a block diagram illustrating a control configuration of the water jet propulsion boat 10. The controller 80 and the power storage 86 are provided in the hull 20. In this preferred embodiment, the power storage 86 includes a first battery 87 and a second battery 88.

The controller 80 is configured or programmed by using, e.g., a CPU, a multi-core CPU, and a programmable device (such as Field Programmable Gate Array (FPGA), Programmable Logic Device (PLD)). The controller 80 is electrically connected to each of the motor 31, the first battery 87, and the second battery 88. The controller 80 supplies power charged in the first battery 87 and the second battery 88 to the motor 31 in response to the operation of the steering device 70. The controller 80 varies the supplied amount of power in response to the operation of the steering device 70 to control the speed of the motor 31.

The water jet propulsion boat 10 is also equipped with a power generator 100 (100A to 100D), which is disposed in the flow path 190 and generates power by using the water flow generated by the impeller 44, as described in detail below. The controller 80 controls the destination of the electric power generated by the power generator 100 provided in the water jet propulsion boat 10. The controller 80 charges the power storage 86 with the power generated by the power generator 100 or supplies power directly to the motor 31 or the electrical equipment 84 provided on the water jet propulsion boat 10. The electrical equipment 84 includes various devices operated by electric power, e.g., the display provided in the steering device 70.

Figure 5B:
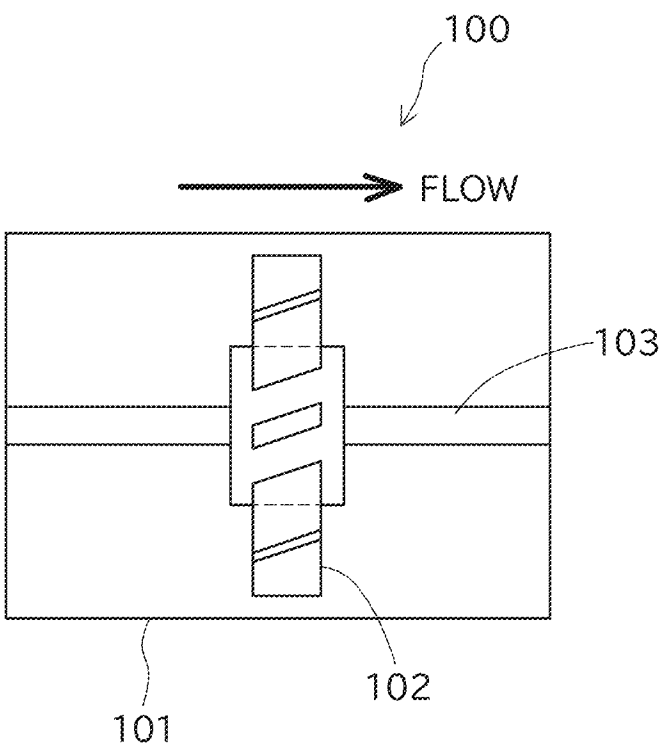
FIGS. 5A and 5B are explanatory views schematically illustrating a detailed configuration of a power generator according to a preferred embodiment of the present invention.
Figure 5A:
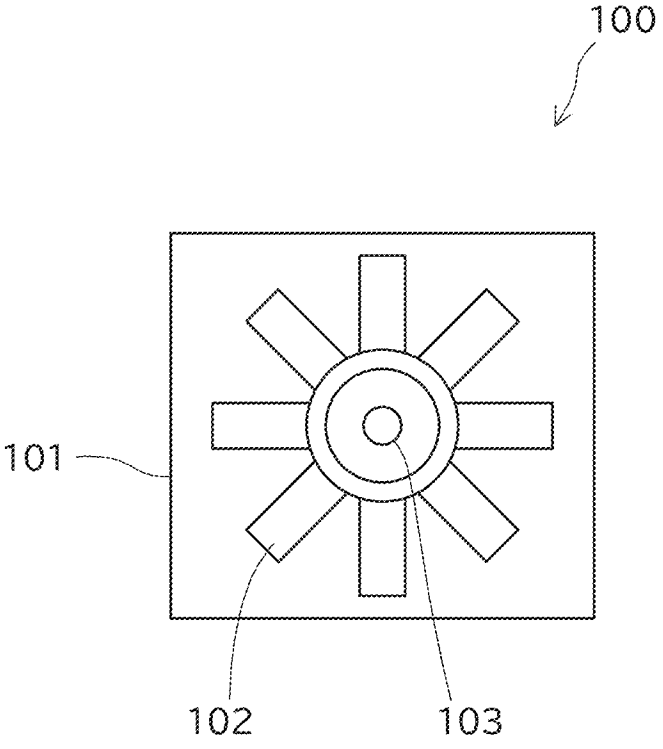

FIGS. 5A and 5B are explanatory views schematically illustrating a detailed configuration of the power generator 100 according to a preferred embodiment of the present invention. The power generator 100 is disposed in the flow path 190 in the hull 20 and uses the water flow generated by the impeller 44 to generate power. FIG. 5A shows the configuration of the power generator 100 when viewed in the water flow direction, and FIG. 5B shows the configuration of the power generator 100 when viewed in the direction crossing the water flow direction. The arrow (FLOW) in FIG. 5B indicates the flow direction of the water flow. The power generator 100 includes a housing 101, an impeller 102, and a rotation shaft 103. The housing 101 houses the impeller 102 and the rotation shaft 103. The rotation shaft 103 is a rod-shaped member and is arranged so that its extension direction is parallel or substantially parallel to the direction of the water flow. The impeller 102 includes blades and is fixed to the rotation shaft 103 so that it can rotate around the rotation shaft 103 due to the water flow. In other words, the power generator 100 generates power by converting the energy of the water flow generated by the impeller 44 into the rotational energy of the impeller 102 and converting the rotational energy of the impeller 102 into electrical energy. The power generator 100 of the present preferred embodiment is a turbine-type power generator in which the direction of extension of the rotation shaft 103 is parallel or substantially parallel to the direction of the water flow.

As shown in FIG. 3, the flow path 190 in the hull 20 includes, in addition to the main flow path 41, a branched flow path 90 branching off from the main flow path 41. The branched flow path 90 includes a cooling water flow path 96 and a spout flow path 99.

Figure 6:
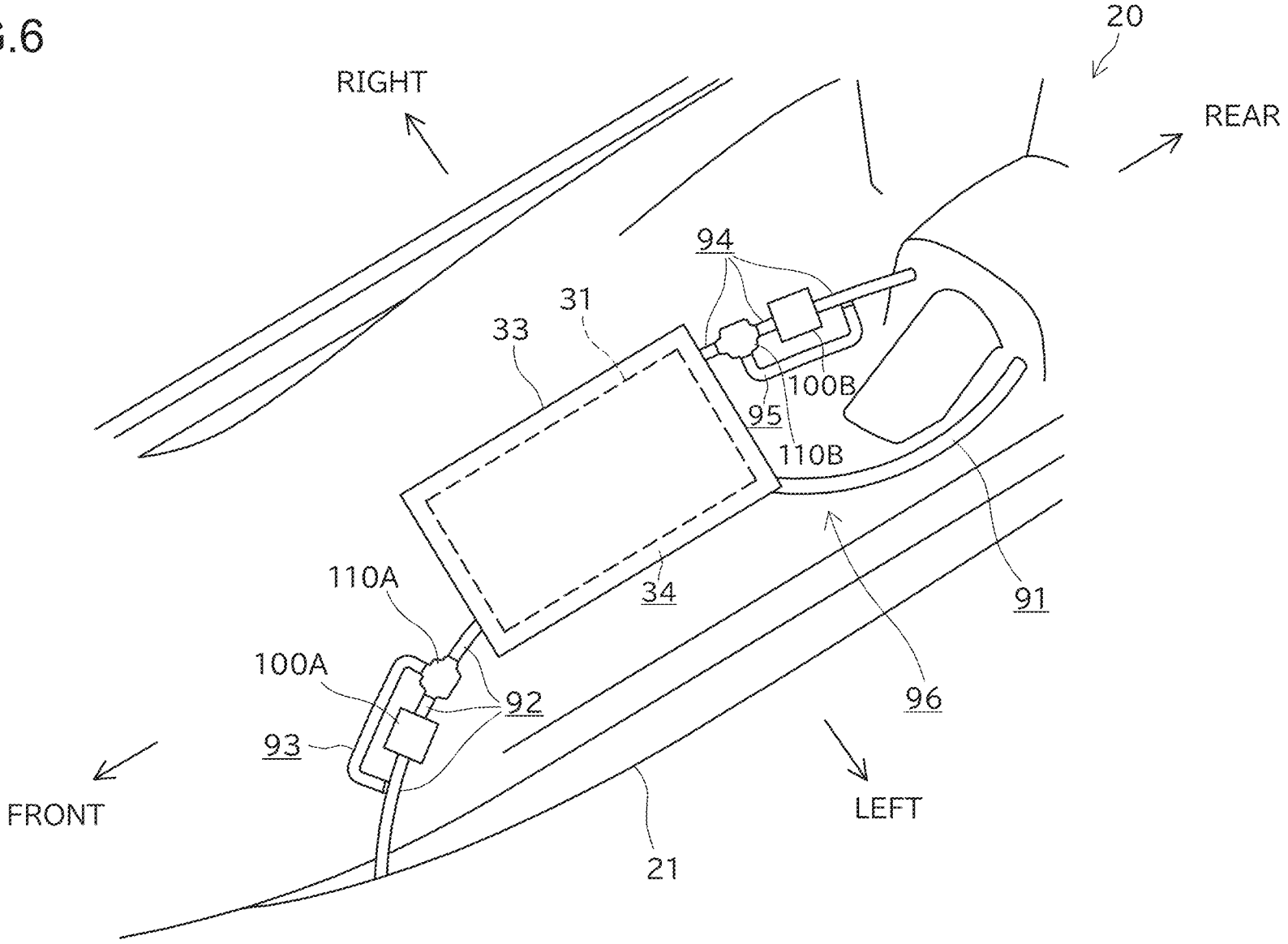
FIG. 6 is an explanatory view schematically illustrating an arrangement of flow paths around a motor.

FIG. 6 is an explanatory view schematically illustrating an arrangement of flow paths around the motor 31. FIG. 6 shows the interior of the hull 20. The cooling water flow path 96 is a flow path for cooling water CW that passes around the motor 31 to cool the motor 31. The cooling water flow path 96 includes a cooling water introduction path 91, a port-side first cooling water flow path 92, a port-side second cooling water flow path 93, a transom-side first cooling water flow path 94, and a transom-side second cooling water flow path 95. The port-side first cooling water flow path 92 is an example of a first cooling water flow path, and the port-side second cooling water flow path 93 is an example of a second cooling water flow path. The transom-side first cooling water flow path 94 is also an example of a first cooling water flow path. The transom-side second cooling water flow path 95 is also an example of a second cooling water flow path.

The power generator 100 (hereinafter specifically referred to as "the power generator 100A") is provided in the port-side first cooling water flow path 92. The port-side second cooling water flow path 93 has a configuration that branches off from a branching point 110A disposed closer to the main flow path 41 than a position where the power generator 100A is disposed in the port-side first cooling water flow path 92 and rejoins the port-side first cooling water flow path 92 again downstream of the power generator 100A. A flow path switching device (not shown), such as a solenoid valve, is provided at the branching point 110A. Also, the power generator 100 (hereinafter specifically referred to as "the power generator 100B") is provided in the transom-side first cooling water flow path 94. The transom-side second cooling water flow path 95 has a configuration that branches off from a branching point 110B disposed closer to the main flow path 41 than a position where the power generator 100B is disposed in the transom-side first cooling water flow path 94 and rejoins the transom-side second cooling water flow path 95 again downstream of the power generator 100B. A flow path switching device (not shown), such as a solenoid valve, is provided at the branching point 110B.

Water taken from the water inlet 42 by the impeller 44 is sent to the cooling water introduction path 91, which branches off from an opening downstream of the impeller 44 in the main flow path 41. The cooling water introduction path 91 extends forward from one end, which is the connection portion with the main flow path 41, to the other end, which is connected to an opening in the water jacket 33. The cooling water CW is sent from the main flow path 41 to the cooling water introduction path 91 and passes through the cooling water tank 34 to cool the motor 31. After passing through the cooling water tank 34, the cooling water CW is sent to the port-side first cooling water flow path 92 or transom-side first cooling water flow path 94.

The port-side first cooling water flow path 92 extends leftward from one end, which is the connection portion with the water jacket 33, to the other end, which is connected to a drain (not shown) on the left side of the hull body 21. The transom-side first cooling water flow path 94 extends rearward from one end, which is the connection portion with the water jacket 33, to the other end, which is connected to a drain (not shown) on the rear side of the hull body 21. Therefore, the cooling water CW used to cool the motor 31 is sent to the port-side first cooling water flow path 92 or the transom-side first cooling water flow path 94 and discharged to the outside of the hull 20 via the drain. At this time, the power generator 100A disposed in the port-side first cooling water flow path 92 and the power generator 100B disposed in the transom-side first cooling water flow path 94 can generate power by using the energy of the cooling water CW.

On the other hand, no power generator 100 is provided in the port-side second cooling water flow path 93. Therefore, when no power is to be generated by the power generator 100A, the controller 80 can bypass the power generator 100A by controlling the flow control device at the branching point 110A to switch the route of the cooling water CW to the port-side second cooling water flow path 93. Similarly, the power generator 100 is not provided in the transom-side second cooling water flow path 95. Therefore, when no power is to be generated by the power generator 100B, the controller 80 can bypass the power generator 100B by controlling the flow control device at the branching point 110B to switch the route of the cooling water CW to the transom-side second cooling water flow path 95. Specifically, when the remaining storage capacity of the power storage 86 is above a predetermined value, the route of the cooling water CW is switched to the port-side second cooling water flow path 93 and the transom-side second cooling water flow path 95, and when the remaining storage capacity of the power storage 86 is below the predetermined value, the route of the cooling water CW is switched to the port-side first cooling water flow path 92 and the transom-side first cooling water flow path 94. This prevents the power storage 86 from becoming overcharged.

Figure 7:
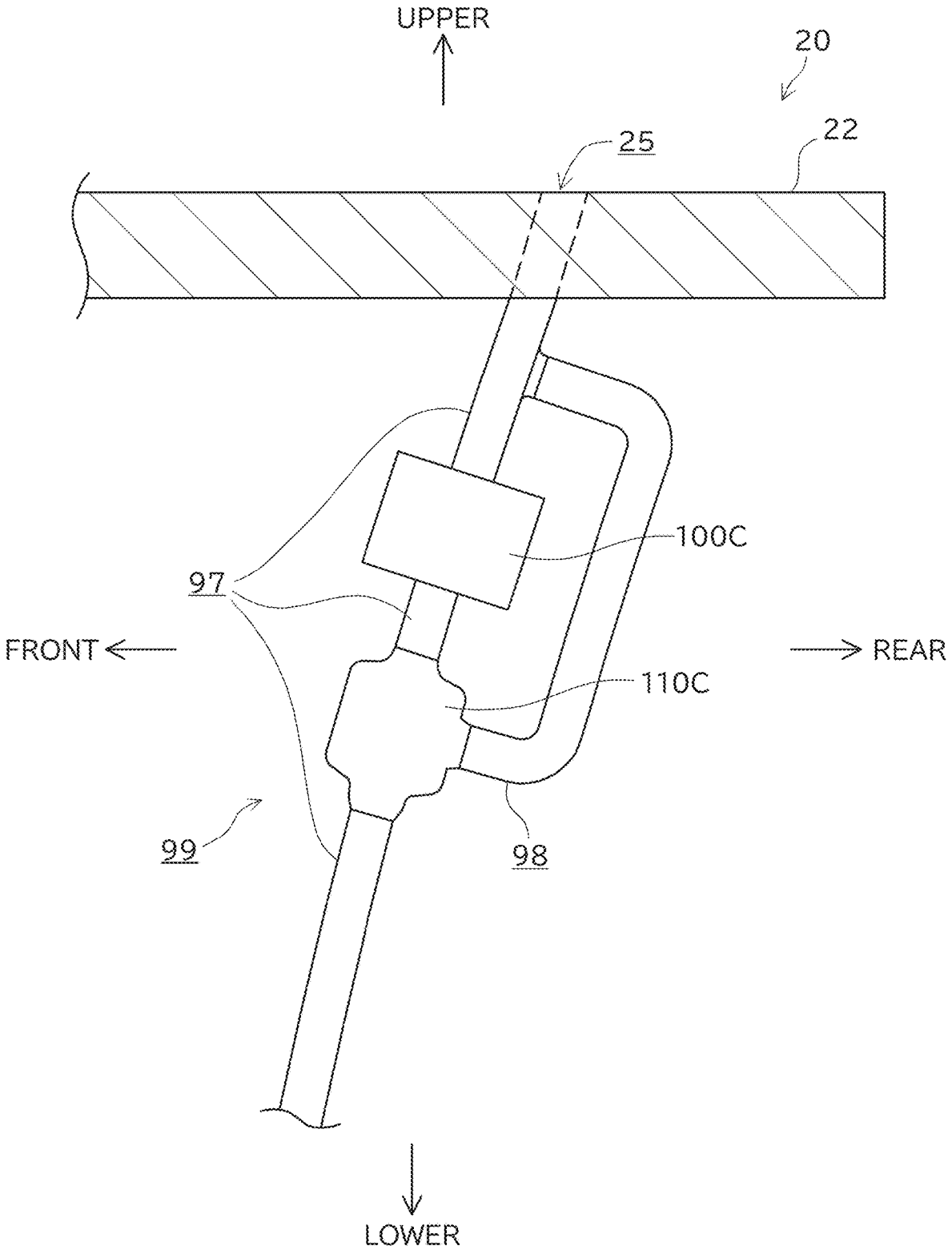
FIG. 7 is an explanatory view schematically illustrating an arrangement of flow paths around a spout ejection port.

In addition to the above, in the event of a predetermined state, the controller 80 controls the flow path switching devices at branching points 110A and 110B to switch the route of the cooling water CW from the port-side first cooling water flow path 92 to the port-side second cooling water flow path 93, or from the transom-side first cooling water flow path 94 to the transom-side second cooling water flow path 95. The predetermined state is, e.g., a state in which foreign matter is trapped in the power generator 100. When foreign matter is trapped in the power generator 100A in the port-side first cooling water flow path 92, the controller 80 switches the route of the cooling water CW to the port-side second cooling water flow path 93 to bypass the power generator 100A. Similarly, when foreign matter is trapped in the power generator 100B in the transom-side first cooling water flow path 94, the controller 80 switches the route of the cooling water CW to the transom-side second cooling water flow path 95 to bypass the power generator 100B. This prevents the temperature of the motor 31 from increasing due to a decrease in the flow rate of the cooling water CW flowing in the cooling water flow path 96 caused by the foreign matter trapped in the power generator 100A or 100B. The controller 80 can determine the trapping of the foreign matter in the power generator 100A and power generator 100B based on changes in the flow rate of the cooling water CW in the port-side first cooling water flow path 92 and the transom-side first cooling water flow path 94, changes in the amount of power generated by the power generator 100A and the power generator 100B, and changes in the temperature of the motor 31, FIG. 7 is an explanatory view schematically illustrating an arrangement of flow paths around a spout ejection port 25. FIG. 7 shows the space between the deck 22 and the mounting portion 24 in the hull 20. The spout flow path 99 is a flow path for the spout water SW that is ejected upward with respect to the hull 20 from the spout ejection port 25. The spout flow path 99 includes a first spout flow path 97 and a second spout flow path 98.

The power generator 100 (hereinafter specifically referred to as "the power generator 100C") is provided in the first spout flow path 97 The second spout flow path 98 has a configuration that branches off from a branching point 110C disposed closer to the main flow path 41 than a position where the power generator 100C is disposed in the first spout flow path 97 and rejoins the first spout flow path 97 again downstream of the power generator 100C. A flow path switching device (not shown), such as a solenoid valve, is provided at the branching point 110C.

Water taken from the water inlet 42 by the impeller 44 is sent to the first spout flow path 97, which branches off from an opening downstream of the impeller 44 in the main flow path 41. The first spout flow path 97 extends upward from one end, which is the connection portion with the main flow path 41, to the other end, which is connected to the spout ejection port 25 in the deck 22. The spout water SW is sent from the main flow path 41 to the first spout flow path 97 and ejected upward with respect to the hull 20 from the spout ejection port 25 so that the crew of the other vessel can recognize the presence of the water jet propulsion boat 10. The power generator 100C disposed in the first spout flow path 97 can generate power by using the energy of the spout water SW.

On the other hand, no power generator 100 is provided in the second spout flow path 98. Therefore, when no power is to be generated by the power generator 100C, the controller 80 can bypass the power generator 100C by controlling the flow control device at the branching point 110C to switch the route of the spout water SW to the second spout flow path 98. Specifically, when the remaining storage capacity of the power storage 86 is above a predetermined value, the route of the spout water SW is switched to the second spout flow path 98, and when the remaining storage capacity of the power storage 86 is below the predetermined value, the route of the spout water SW is switched to the first spout flow path 97. This prevents the power storage 86 from becoming overcharged.

In addition to the above, in the event of a predetermined state, the controller 80 controls the flow path switching device at branching point 110C to switch the route of the spout water SW from the first spout flow path 97 to the second spout flow path 98. The predetermined state is, e.g., a state in which foreign matter is trapped in the power generator 100. When foreign matter is trapped in the power generator 100C in the first spout flow path 97, the controller 80 switches the route of the spout water SW to the second spout flow path 98 to bypass the power generator 100C. This prevents the foreign matter trapped in the power generator 100C from reducing the flow rate of the spout water SW ejected from the spout ejection port 25. The controller 80 can determine the trapping of the foreign matter in the power generator 100C based on changes in the flow rate of the spout water SW in the first spout flow path 97 and the amount of power generated by the power generator 100C.

As shown in FIG. 3, the power generator 100 (hereinafter specifically referred to as "the power generator 100D") is also provided in the main flow path 41. The power generator 100D is disposed downstream of the impeller 44 in the main flow path 41. The power generator 100D disposed in the main flow path 41 can generate power by utilizing the energy of the water flow of the water taken in by the impeller 44 before it is ejected as the jet JW.

The power generated by the power generator 100 in the manner described above is supplied to the power storage 86, the motor 31, and the electrical equipment 84 under the control of the controller 80. The power storage 86 includes two batteries, the first battery 87 and the second battery 88. The controller 80 switches the states of the first battery 87 and the second battery 88 between a charging state to be charged with power generated by the power generator 100 and a supplying state to supply power to the motor 31. This allows both charging the power storage 86 and supplying power from the power storage 86 to the driving device 30 even while the water jet propulsion boat 10 is underway.

The technologies disclosed herein are not limited to the preferred embodiments described above but can be modified in various ways without departing from the gist of the present invention, e.g., the following modifications are possible.

The configuration of the water jet propulsion boat 10 in the above preferred embodiments is only an example and can be modified in various ways. For example, in the above preferred embodiments, only the motor 31 is shown as the drive source of the driving device 30, but the drive source may be an engine or the like together with or instead of the motor 31.

Although the water jet propulsion boat 10 of the above preferred embodiments is a personal watercraft, it may be, e.g., a sport boat or other vessel equipped with a jet propulsion mechanism.

In the above preferred embodiments, the power storage 86 is provided with two batteries, the first battery 87 and the second battery 88, but may be provided with three or more batteries.

In the above preferred embodiments, the cooling water flow path 96, the spout flow path 99, and the main flow path 41 are shown as flow paths where the power generator 100 is disposed, but the flow paths are not limited to these, and the power generator 100 may be disposed in any of the paths of water flow generated by the impeller 44.

In the above preferred embodiments, the main flow path 41 is defined by the duct 41*a*, the impeller housing 41*b*, the stator blade housing 41*c*, and the nozzle 41*d* assembled in one piece, but the main flow path 41 may be defined by a single component.

In the above preferred embodiments, the cooling water flow path 96 and the spout flow path 99 branch off from downstream of the impeller 44 in the main flow path 41, but the cooling water flow path 96 and the spout flow path 99 may branch off from upstream of the impeller 44 in the main flow path 41.

In the above preferred embodiments, the state in which foreign matter is trapped in the power generator 100 is shown as an example for the predetermined state in which the flow paths are switched by the flow control device between the port-side first cooling water flow path 92 and the port-side second cooling water flow path 93, between the transom-side first cooling water flow path 94 and the transom-side second cooling water flow path 95, or between the first spout flow path 97 and the second spout flow path 98, respectively, but the predetermined state is not limited to this. For example, the predetermined state may include a state in which the rotation shaft 103 is broken, a state in which the amount of power generated by the power generator 100 has decreased, a state in which power is generated by the power generator 100 but the power storage 86 is not charged, and a state in which water leakage occurs between the power generator 100 and the branched flow path 90, among other states.

In the above preferred embodiments, the power generator 100D disposed in the main flow path 41 is downstream of the impeller 44 in the main flow path 41 but may be upstream of the impeller 44.

In the above preferred embodiments, the power generator 100D disposed in the main flow path 41 generates power by using the water flow before it is ejected as the jet JW, but the power generator 100D may also generate power by using the jet JW after it is ejected from the jet outlet 48. For example, the power generator 100D may be attached to the reverse gate 52 to generate power by using the water flow of the jet stream JW.

In the above preferred embodiments, the power generator 100A and the power generator 100B disposed in the cooling water flow path 96 are downstream of the cooling water tank 34 but may be upstream of the cooling water tank 34 (i.e., the cooling water introduction path 91).

Figure 8B:
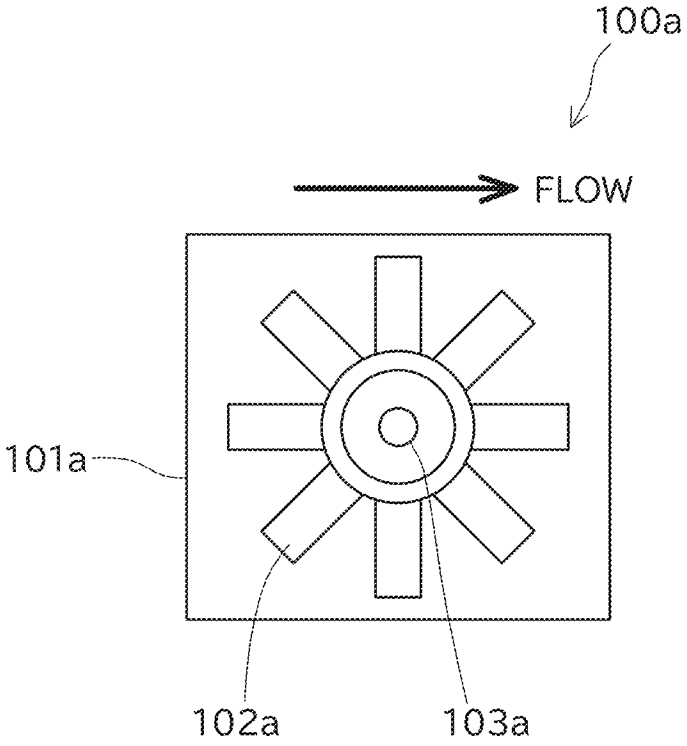
FIGS. 8A and 8B are explanatory views schematically illustrating a detailed configuration of a power generator according to a modified preferred embodiment of the present invention.
Figure 8A:
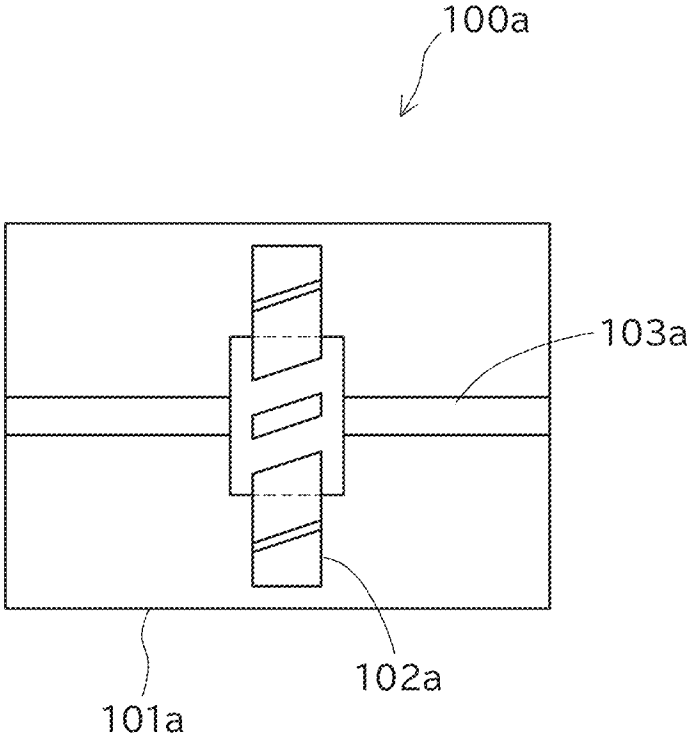

In the above preferred embodiments, the water jet propulsion boat 10 is equipped with the turbine-type power generator 100, but the configuration of the power generator 100 is not limited to this. FIGS. 8A and 8B are explanatory views schematically illustrating a detailed configuration of a power generator 100*a* according to a modified preferred embodiment of the present invention. The water jet propulsion boat 10 may be equipped with a water wheel-type power generator 100*a*, e.g., as shown in FIGS. 8A and 8B. FIG. 8A shows the configuration of the power generator 100*a* when viewed in the water flow direction, and FIG. 8B shows the configuration of the power generator 100*a* when viewed in a direction crossing the water flow direction. The arrow (FLOW) in FIG. 8B indicates the flow direction of the water flow. The power generator 100*a* includes a housing 101*a*, an impeller 102*a*, and a rotation shaft 103*a*. The water wheel-type power generator 100*a* is arranged so that the extension direction of the rotation shaft 103 intersects the flow direction of the water flow. Similar to the power generator 100, the power generator 100*a* can generate power by converting the energy of the water flow generated by the impeller 44 into the rotational energy of the impeller 102*a* and converting the rotational energy of the impeller 102*a* into electrical energy.

In the above preferred embodiments, the water jet propulsion boat 10 includes the port-side flow paths (the port-side first cooling water flow path 92 and the port-side second cooling water flow path 93) as flow paths for the cooling water CW that passes around the motor 31 until it is discharged to the outside the hull 20, but the configuration of the flow paths for the cooling water CW is not limited to this. For example, the cooling water CW that passes around the motor 31 may be discharged to the outside of the hull 20 via the starboard side flow path, and the power generator 100 may be arranged in the starboard side flow path.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A water jet propulsion boat comprising:

a hull including a water inlet, a jet outlet, and a flow path connecting the water inlet and the jet outlet and including a main flow path extending from the water inlet to the jet outlet;

a drive source in the hull;

a power storage to supply power to the drive source;

a jet propulsion mechanism including an impeller in the main flow path and driven by a driving force of the drive source to generate a water flow in the flow path to generate a propulsive force;

a power generator in the flow path to use the water flow generated by the impeller to generate power; and a controller configured or programmed to charge the power storage by using the power generated by the power generator; wherein the flow path includes a branched flow path extending from the main flow path; and the power generator is in the branched flow path.

2. The water jet propulsion boat according to claim 1, wherein the branched flow path includes a first cooling water flow path to pass cooling water around the drive source to cool the drive source; and the power generator is in the first cooling water flow path.

3. The water jet propulsion boat according to claim 2, wherein the branched flow path includes a second cooling water flow path branching from a branching point closer to the main flow path than a position where the power generator is in the first cooling water flow path;

the power generator is not located in the second cooling water flow path; and the controller is configured or programmed to switch a route of the cooling water between the first cooling water flow path and the second cooling water flow path at the branching point.

4. The water jet propulsion boat according to claim 3, wherein the controller is configured or programmed to:

switch the route of the cooling water to the second cooling water flow path when a remaining storage capacity of the power storage is above a predetermined value; and switch the route of the cooling water to the first cooling water flow path when the remaining energy storage capacity of the power storage is below the predetermined value.

5. The water jet propulsion boat according to claim 3, wherein the controller is configured or programmed to switch the route of the cooling water to the second cooling water path when foreign matter is trapped in the power generator in the first cooling water path.

6. The water jet propulsion boat according to claim 5, wherein the controller is configured or programmed to determine when the foreign matter is trapped in the power generator based on a change in the flow rate of the cooling water in the first cooling water flow path.

7. The water jet propulsion boat according to claim 5, wherein the controller is configured or programmed to determine when the foreign matter is trapped in the power generator based on a change in an amount of power generated by the power generator.

8. The water jet propulsion boat according to claim 5, wherein the controller is configured or programmed to determine when the foreign matter is trapped in the power generator based on a change in a temperature of the drive source.

9. The water jet propulsion boat according to claim 1, further comprising:

a spout ejection port on a top surface of the hull; wherein the branched flow path includes a first spout flow path to eject spout water upward with respect to the hull from the spout ejection port; and the power generator is in the first spout flow path.

10. The water jet propulsion boat according to claim 9, wherein the branched flow path includes a second spout flow path branching from a branching point closer to the main flow path than a position from where the power generator is in the first spout flow path;

the power generator is not located in the second spout flow path; and the controller is configured or programmed to switch a route of the spout water between the first spout flow path and the second spout flow path at the branching point.

11. The water jet propulsion boat according to claim 10, wherein the controller is configured or programmed to:

switch a route of the spout water to the second spout flow path when a remaining storage capacity of the power storage is above a predetermined value; and switch the route of the spout water to the first spout flow path when the remaining storage capacity of the power storage is below the predetermined value.

12. The water jet propulsion boat according to claim 10, wherein the controller is configured or programmed to switch the route of the spout water to the second spout flow path when foreign matter is trapped in the power generator in the first spout flow path.

13. The water jet propulsion boat according to claim 12, wherein the controller is configured or programmed to determine that the foreign matter is trapped in the power generator based on a change in a flow rate of the spout water in the first spout flow path.

14. The water jet propulsion boat according to claim 12, wherein the controller is configured or programmed to determine that the foreign matter is trapped in the power generator based on a change in an amount of power generated by the power generator.

15. The water jet propulsion boat according to claim 1, wherein the power storage includes a first battery and a second battery; and the controller is configured or programmed to switch a state of the first battery and the second battery between a charging state to be charged with power generated by the power generator and a supplying state to supply power to the drive source.

16. The water jet propulsion boat according to claim 1, wherein the power generator includes blades that are rotatable in response to water flow.

17. A water jet propulsion boat comprising:

a hull including a water inlet, a jet outlet, and a flow path connecting the water inlet and the jet outlet and including a main flow path extending from the water inlet to the jet outlet;

a drive source in the hull;

a jet propulsion mechanism including an impeller in the main flow path and driven by a driving force of the drive source to generate a water flow in the flow path to generate a propulsive force to the hull;

a power generator in the flow path to use the water flow generated by the impeller to generate power;

electrical equipment on the hull; and a controller configured or programmed to supply power generated by the power generator to the electrical equipment; wherein the flow path includes a branched flow path extending from the main flow path; and the power generator is in the branched flow path.

18. A water jet propulsion boat comprising:

a hull including a water inlet, a jet outlet, and a flow path connecting the water inlet and the jet outlet and including a main flow path extending from the water inlet to the jet outlet;

a drive source in the hull;

a power storage to supply power to the drive source;

a jet propulsion mechanism including an impeller in the main flow path and driven by a driving force of the drive source to generate a water flow in the flow path to generate a propulsive force;

a power generator in the flow path to use the water flow generated by the impeller to generate power; and a controller configured or programmed to charge the power storage by using the power generated by the power generator; wherein the power generator is in the main flow path; and the power generator is downstream of the impeller in the main flow path.

19. A water jet propulsion boat comprising:

a hull including a water inlet, a jet outlet, and a flow path connecting the water inlet and the jet outlet and including a main flow path extending from the water inlet to the jet outlet;

a drive source in the hull;

a jet propulsion mechanism including an impeller in the main flow path and driven by a driving force of the drive source to generate a water flow in the flow path to generate a propulsive force to the hull;

a power generator in the flow path to use the water flow generated by the impeller to generate power;

electrical equipment on the hull; and a controller configured or programmed to supply power generated by the power generator to the electrical equipment; wherein the power generator is in the main flow path; and the power generator is downstream of the impeller in the main flow path.

* * * * *